US006482467B2

(12) United States Patent
Miyasaka

(10) Patent No.: US 6,482,467 B2
(45) **Date of Patent: *Nov. 19, 2002**

(54) CERAMIC COATED PRODUCT, AND METHOD FOR FORMING THE CERAMIC COATED PRODUCT

(75) Inventor: Yoshio Miyasaka, Aichi (JP)

(73) Assignee: Fuji Kihan Co., Ltd., Aichi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/197,722

(22) Filed: Nov. 23, 1998

(65) Prior Publication Data

US 2002/0009542 A1 Jan. 24, 2002

(30) Foreign Application Priority Data

Nov. 25, 1997 (JP) ..... 9-323333

(51) Int. Cl.[7] ..... B05D 1/02

(52) U.S. Cl. ..... 427/180; 427/191; 427/192; 427/427; 148/537

(58) Field of Search ..... 427/191, 192, 427/198, 180, 272, 287, 328, 349, 475, 727; 148/516, 537

(56) References Cited

U.S. PATENT DOCUMENTS 3,674,544 A 7/1972 Grosseau
3,996,398 A * 12/1976 Manfredi
5,399,207 A * 3/1995 Kemp

FOREIGN PATENT DOCUMENTS

| | | | |
|---|---|---|---|
| EP | 0 552 004 A1 | | 7/1993 |
| GB | 1182242 | | 2/1970 |
| JP | 60092461 A | | 10/1983 |
| JP | 8-333671 | * | 12/1996 |

OTHER PUBLICATIONS

Hakh's Chemical Dictionary, 4th Edition, p. 457, 1969.*
Randon House Unabridged Dictionary, 2nd Edition, p. 1302, 1983.*
Encyclopedia of Chemical Technology, vol. 17, p. 115, 4th Edition, 1996.*

* cited by examiner

*Primary Examiner*—Fred J. Parker
(74) *Attorney, Agent, or Firm*—Knobbe, Martens, Olson & Bear, LLP

(57) ABSTRACT

Provided is a ceramic coated product and a coating for it, making it possible to improve corrosion resistance, wear resistance and the like of a material to be treated, and heighten aesthetically commercial value by a thin film forming or producing method using low-priced equipment. An ejection powder and a reactive ejecting gas are ejected onto a surface of a material to be treated comprising a metal product, a ceramic, or a mixture thereof. The ejection powder is heated on the surface of the material to be treated and then is reacted with the reactive ejecting gas. The resultant product is activation-adsorbed onto the surface of the material to be treated and caused to diffuse and penetrate thereinto. Thus, a layer made of a nitride or other compounds is formed.

10 Claims, No Drawings

CERAMIC COATED PRODUCT, AND METHOD FOR FORMING THE CERAMIC COATED PRODUCT

BACKGROUND OF THE INVENTION

1. Field of the Invention

The present invention relates to a ceramic coated product, including a product by what is called fine nitriding, i.e., formation of a fine nitrogen compound layer on a surface layer of a metal material for the purpose of surface hardening or the like. The present invention also relates to a ceramic coating method for forming a ceramic coating layer, which should be taken in the wide sense, in manufacture of a ceramic coated product obtained by using as a raw material a nitride, an oxide or a boride, for the purpose of protection, decoration, lubrication or the like of the surface of a material to be treated as a workpiece, such as wear resistance, corrosion resistance or heat resistance thereof, using excellent mechanical properties of the ceramic; in coating of the ceramic coating layer; or in production of the ceramic coat.

More specifically, nitriding is a manner of ejecting an ejection powder by a reactive ejecting gas, for example, compressed nitrogen gas, on the surface of a metal product, as a workpiece, comprising a ferrous metal such as steel or cast iron, a metal product comprising a non-ferrous metal such as aluminum or brass, or a metal product comprising a powdery alloy, such as a hard metal, a ceramic alloy, or a cermet, or on the surface of a material to be treated comprising a ceramic or a mixture of these, so as to produce on the surface of the material to be treated a nitride layer of a compound resulting from the reaction of the ejection powder and the reactive ejecting gas. In particular, the present invention relates to ceramic coating, comprising a nitriding treatment step wherein nitriding treatment which has not been conventionally made practicable for nitriding of aluminum and aluminum alloys is made practicable at ordinary temperature, and relates to ceramic coating, as a general term having broad senses, comprising the nitriding treatment step in the present invention for forming or applying an inorganic material and an intermetallic compound, including the aforementioned nitride layer, on the surface of the aforementioned material to be treated.

2. Description of Prior Art

As conventional nitriding treatments, the following have been carried out: gas nitriding and oxynitriding using ammonia gas at about 550° C. for 20–100 hours; salt-bath nitriding to be performed at about 580° C. in a bath of a mixture of a cyanide and a cyanate; and ion nitriding in which nitrogen ionized in glow discharge is caused to penetrate and diffuse into steel in a decompressed atmosphere into which N2 is introduced. Besides, gas soft-nitriding and nitrosulphurizing treatments have been carried out.

Incidentally, ceramic coating methods are plasma thermal spray, PVD (physical vapor deposition), CVD (chemical vapor deposition), and the like methods.

The plasma thermal spray is a manner of supplying a thermal spray powder into a super high temperature and high-speed flow jet produced by ejecting from a narrow nozzle an inactive gas, such as argon, made into plasma by arc; and melting and accelerating the thermal spray powder to form a coat on the surface of a substrate. This manner has been applied to formation of a high density and high strength coat made of metal materials such as molybdenum and nickel based alloys, and formation of a thin film made of high melting-point materials such as ceramics.

The PVD method is a manner of heating a solid to a high temperature or vaporizing and condensing a solid forcibly, with no chemical reaction, to form a thin film, and is grouped into vapor deposition, ion plating, sputtering and the like.

The vapor deposition is a manner of heating and vaporizing a substance in a vacuum, and depositing it in a layer-form on a surface of a material to be treated, thereby forming a thin layer, and has a characteristic making it possible to easily make various substance a thin layer and obtain a large and uniform thin film, and the like characteristics.

The ion plating is a manner of using plasma generated by applying an electric field to ionize or excite vaporized atoms, thereby forming a thin film.

The sputtering is a manner of generating ionized plasma in a relatively low degree of vacuum, accelerating ionized argon and causing collision of the argon with a target (a solid material which is a target of collision of the accelerated particles) to sputter target atoms, thereby coating the surface of a material to be treated.

The CVD is a manner of forming a thin film by chemical reaction of vapor of a metal or a volatile compound in a gas phase, and is grouped into electric furnace, chemical flame, electron beam, laser, plasma and the like methods, dependently on a heat source for the gas phase reaction.

Conventional nitriding treatments, including gas nitriding, have problems that treating temperature is generally very high, that treating time is also long, that the cost of equipment is necessarily high, and that pollution accompanies in cyanogen treatment or the like.

Concerning in particular nitriding of aluminum, aluminum alloys and the like, nitriding is not liable to penetrate into their surface since an oxide film is formed on the surface. Nitriding in a vacuum can be carried out, but is of no practical use from the viewpoint of productivity and cost. As for stainless steel, nitriding treatment thereof has problems of decrease in its strength by washing by an acid, and an outbreak of pollution, as well as the same problems as in case of aluminum and the like.

Besides, conventional ceramic coating methods have the following problems.

For example, the vacuum vapor method has a problem that the cost of equipment is high for a vacuum tank, a rotary pump or a oil diffusion pump for evacuating the vacuum tank, and the like.

Besides, in the other methods, i.e., the PVD and various types of CVD, expensive equipment is necessary, and the methods have a problem of high cost.

The sputtering has a problem that the rate of depositing a film is at most several hundreds Å/minute, and this method is not suitable for forming a thick film.

The present invention has been made to solve the aforementioned problems. An object and an effect of the present invention are to provide a ceramic coated product and a coating method for it, making it possible to improve protecting and lubricating effects of the surface of a material to be treated, such as wear resistance, corrosion resistance and heat resistance thereof, and to raise commercial value of its appearance based on decoration, by a method for manufacturing, forming or producing a thin film which comprises ejecting an ejection powder on the surface of the material to be treated by reactive ejecting gas to form on the surface of the material to be treated a compound layer produced by reaction of the ejection powder and the reactive ejecting gas, in low-priced equipment. Specifically, an object and an effect of the present invention are to provide ceramic coating making it possible to carry out the same treatment as by conventional coating methods by blasting, in low-priced mechanical equipment, for a short time, improve protecting and lubricating effects of the surface of a material to be treated, such as wear resistance, corrosion resistance, and heat resistance thereof, make its appearance beautiful, and raise commercial value at a lower cost than conventional ceramic coating methods; or a product related to a ceramic coat containing fine nitride by a quite new manner in simple equipment at ordinary temperature, the equipment not causing pollution; and a coating method for it.

SUMMARY OF THE INVENTION

The means for attaining the ceramic-coated products of the present invention include a material to be treated, as a metal product having a nitrogen reactive component, and an ejection powder; a material to be treated comprising a mixture of the metal product and a ceramic, and an ejection powder; or a material to be treated comprising a ceramic, and an ejection powder containing a nitrogen reactive component. The fine nitride comprises a nitrogen compound obtained by chemically reacting these in a nitrogen gas atmosphere, and is a product wherein a nitride is caused to diffuse and penetrate into the surface of the material to be treated or a coat formed on the surface of the material to be treated. The coating method is characterized by using a material to be treated comprising a metal product having a nitrogen reactive component, or a material to be treated comprising a mixture of the metal product and a ceramic, or a material to be treated comprising a ceramic, and an ejection powder containing a nitrogen reactive component; ejecting on the surface of the material to be treated a mixture flow of the ejection powder and nitrogen gas by blasting; and causing a nitrogen compound produced by the chemical reaction of the material to be treated containing the nitrogen reactive compound and/or the ejection powder with the nitrogen gas to diffuse and penetrate into the surface of the material to be treated, thereby producing a nitride layer.

The ceramic coated product of the present invention is characterized by causing various compounds, for example, oxides, carbides, nitrides and other intermetallic compounds produced by chemical reaction of the ejection powder and the reactive ejecting gas to diffuse and penetrate into the surface of a material to be treated of a metal, a ceramic or a mixture thereof; or applying the various compounds onto the surface.

The coating method for the aforementioned product is characterized by carrying out blasting using nitrogen gas as a compressed gas which is an ejecting gas for a fine nitride, or using a reactive ejecting gas of a gas containing oxygen, carbon or the like, as well as nitrogen, that is, a highly reactive gas exhibiting oxidation, carburizing, nitriding, or the like, or a mixture gas comprising several kinds of such gasses so as to eject an ejection powder, which has the average particle size of 200-20 $\mu$m, and preferably 100-20 $\mu$m, and nitrogen alone or a mixture flow of the aforementioned reactive ejecting gas as a reactive ejecting gas on the surface of a material to be treated of the metal product, the ceramic or a mixture thereof satisfying the above condition, at an ejection speed of 80 m/sec or more or at an ejection pressure of 0.3 Mpa, thereby diffusing and penetrating or applying elements in the compositions of the material to be treated or the ejection powder and the reactive ejecting gas to form a nitrified layer or a layer of the aforementioned compound.

An abrasive is separate powders or particles containing small particles and fine powders which may be used for polishing and surface-cleaning all materials including metals and synthetic resins. The blasting or sandblasting is a general term of means for ejecting solid/gas two-phase flow of the abrasive made of a metal or the like and a gas, and includes shot peening.

The aforementioned average particle size is shown by a size obtained by averaging the average particle size of the maximum particle and the average particle of the thirtieth particle from the maximum particle.

Concerning the fine particle having an average particle size of, for example, 80 $\mu$m, the average particle size of the maximum particle is 171 $\mu$m or less, the average particle size of the thirtieth particle from the maximum particle is 120 $\mu$m or less, and thus the average of these average particle sizes is from 87.5 to 73.5 $\mu$m (JIS R 6001).

When the ejection powder is ejected at a high ejection speed onto the surface of a material to be treated by blasting, thermal energy is generated by change in the speed of the ejection powder before and after collision of the powder with the surface of the material to be treated, in the light of the energy conservation law. This energy conversion occurs only in deformed portions, with which the ejection powder collides. Thus, temperature rises locally in the ejection powder, the reactive ejecting gas and the vicinity of the surface of the material to be treated.

The rise in temperature is in proportion to the speed before the collision of the ejection powder. Therefore, if the ejection speed of the ejection powder is made high, temperature can be raised in the ejection powder, the reactive ejecting gas and the surface of the material to be treated. At this time, the ejection powder is heated on the surface of the material to be treated and consequently chemical reaction arises between elements in the ejection powder and the reactive ejecting gas, so as to produce a compound. Furthermore, the resultant compound is activation-adsorbed on the surface of the material to be treated by a rise in temperature of the compound so that the compound diffuses and penetrates into the surface or is applied thereto. It appears that in this way a nitride layer or a coat of the other compound is formed on the surface of the material to be treated.

Simultaneously, effect of surface-processing heat treatment as shot peening is obtained.

Therefore, the fine nitride, the ceramic coated product, and the coating method for it of the present invention, which are different from conventional ceramic coating, are concerned with a quite new manner of forming respective compound layers by diffusion and penetration, or coating of compounds onto the surface of a material to be treated, the compounds being produced by chemical reaction of the ejection powder and the ejecting gas, resulting from a rise in temperature of the ejection powder when the ejection powder collides with the material to be treated by blasting.

For more specific explanation, vacuum vapor deposition, which is a conventional ceramic coating method, is given as an example. In this method, a material of a thin film is heated and vaporized at a high degree vacuum whose pressure is usually 1×10−6 Torr or less to deposit the vaporized particles on the surface of a material to be treated, thereby forming the thin film. To form a thin film of, in particular, an oxide, a nitride or a carbide, a metal constituting the compound is used as a material of the thin film, and vaporized in a reactive atmosphere gas such as oxygen, nitrogen, ammonia or methane. This make it possible to deposit the thin film of the compound by any one of reaction steps of generation of particles from mutual addition of the reactants and thermal decomposition thereof into an oxide, a nitride, or a carbide; generation of nuclei of an oxide, a nitride, a carbide, and growth thereof; or generation of metal particles, and oxidation, nitriding or carbonization. For example, when Al and oxygen are used as a material of the thin film and the atmosphere gas, respectively, at a pressure of 10–5-10–4 Torr, a ceramic thin film of $Al_2O_3$ is formed at 400–500° C. If ammonia is used as the atmosphere gas, polycrystal AlN is formed at 300° C.

Additionally, giving carburizing as an example, deposition of particles onto the surface of a material to be treated will be considered. In case wherein CO gas adheres to the surface of a ferrous metal product by a mere physical manner, such as external force, heating and others so that it is can be easily removed, Fe in the product cannot be reacted with CO. However, if heat or other energy is given thereto at a certain level or more, CO gas is activation-adsorbed on the surface of Fe. The activation-adsorbed CO gas is thermally dissociated into carbon dioxide and carbon. It has been considered that carbon generated by this reaction diffuses into Fe lattices to cause a carburizing phenomenon. In not only diffusion of carbon but also diffusion of any one of elements into a certain metal, the manner thereof is classified into surface diffusion (diffusion advancing along its surface), boundary diffusion (diffusion advancing along its crystal boundary) and lattice diffusion (diffusion advancing in its crystal lattices so as to sew the lattices). Lattice diffusion is caused only in case wherein both of the element and the metal form solid solution. Only surface diffusion and boundary diffusion are caused in case wherein both of the element and the metal do not form solid solution.

Considering the aforementioned vacuum vapor deposition and carburizing, it can be thought that in the ceramic coating of the present invention a compound layer is produced on a material to be treated by steps as described in the following.

For example, when an ejecting powder is ejected on the surface of a material to be treated at an ejection speed of 80 m/sec or more, or at an ejection pressure of 0.3 MPs or more to collide with the surface of the material to be treated, the speed of the ejection powder is reduced after the collision. Considering the energy conservation law, thermal energy is generated by inner friction based on deformation of the collision portion of the material to be treated in the collision, and then by this thermal energy the ejection powder is heated on the surface of the material to be treated. Therefore, the ejection powder and ejecting gas are simultaneously activated and reacted, and further the resultant compound is activation-adsorbed onto the workplace to diffuse and penetrate onto the material to be treated, or coat it. It can be thought that in this way the compound layer is formed.

As for compressed nitrogen gas, it can be thought that temperature of the surface of the material to be treated rises at a nitrogen penetration/diffusion temperature or higher, so that the surface reacts with nitrogen gas, whereby nitriding is carried out.

The object of the present invention is to activation-absorb the compound on the surface of a material to be treated by using a rise in temperature of an ejection powder. Thus, in order that the ejection powder is instantaneously heated by the aforementioned thermal energy, the ejection powder should not comprise heavy shots, but it needs to comprise shots having a particle size of 200-20 $\mu$m in a powdery form, that is, ejection fine particles. The particle size is preferably 100 $\mu$m or less, from the viewpoint of thickness of the film and improvement in adhesion. Considering effective conversion into the thermal energy at the aforementioned ejection speed, the ejection pressure is preferably 0.3 MPa or more.

Moreover, heating an ejecting gas, a material to be treated, or both of them are more effective to heighten reactivity.

Although nitrogen gas is necessary for fine nitriding, it is sufficient that a nitrogen reactive component is contained in either one of a material to be treated or an ejecting powder. When the nitrogen reactive component is contained in the ejecting powder, a coat is formed on the surface of the material to be treated by the ejection powder and simultaneously a nitride is produced in the coat. In the method of the present invention, either one of them is at least reacted so that a nitride layer is produced, or coating with a nitride layer is performed.

For example, in the case wherein compressed nitrogen gas is used to eject a mixture flow, if the material to be treated comprises a metal material containing Ti, V, Al, Cr or the like as a nitrogen reactive component and the ejecting powder comprises a similar metal, a nitride layer made of TiN, VN, AlN, CrN or the like is produced on the surface of the material to be treated by diffusion and penetration. Simultaneously, a nitride is also produced in the surface coat covered with the ejection powder. If the surface of the material to be treated is the same as the above and the ejection powder comprises a ceramic or the like, which does not contain any nitrogen reactive component, a nitride is generated only on the surface of the material to be treated. If both of the material to be treated and the ejection powder contain the nitrogen reactive component, a nitride is produced on the surface of the material to be treated and in the coat.

In this case, similarly a coat can be formed by the ejection powder. Additionally speaking, in the case wherein the material to be treated comprises a mixture of a metal material containing Ti, V, Al, Cr or the like, or a mixture of this metal and a ceramic, if the ejection powder is the same as the material to be treated, a nitride is produced in both of the material to be treated and the coat. If the material to be treated comprises a ceramic and the ejection powder comprises the aforementioned mixture, a nitride is produced only in the coat.

In other words, if only the material to be treated contains the nitrogen reactive component, a nitride is produced on the surface of the material to be treated; if both of the material to be treated and the ejection powder do not contain any nitrogen reactive component, nitriding is not carried out; and if only the ejection powder contains the nitrogen reactive component, a nitride is produced only in the formed coat.

DETAILED DESCRIPTION OF THE PREFERRED EMBODIMENTS

A blast machine used in Example 1 which will be described later is a gravity blast machine, but any other air type blast machines may be used, wherein ejection energy of a compressed gas is used to blow an abrasive. Examples thereof are a siphon or suction blast machine, which is in an absorption type, and a straight hydraulic blast machine.

In the straight hydraulic blast machine, in a recollecting tank of an abrasive, which is herein a powder, the abrasive after ejection and dust are separated, and the dust is fed through a duct to a dust collector having an exhauster, and the abrasive drops down to the lower portion of the recollecting tank so that the abrasive is collected at this portion. A pressure tank is disposed, through a dump valve, under the recollecting tank. When the abrasive is removed away from the pressure tank, the dump valve goes down so that the powdery abrasive in the recollecting tank is introduced into the pressure tank. When the powder is introduced into the pressure tank, a compressed gas is charged into this tank. Simultaneously, the dump valve is closed so that the pressure in the pressure tank rises. Thus, the powder is forced out from a supplying opening at the lower position of the tank. To the supplying opening, a compressed gas as a reactive ejecting gas is separately introduced, and the powder is carried to a nozzle by a hose. The powder is then ejected together with the gas at a high speed from its nozzle tip.

The outline of the suction blast machine will be described in brief. When a compressed gas is ejected from a hose connected to a source for supplying the compressed gas as a reactive ejecting gas into an ejection nozzle for suction, the inside of the nozzle is made into a negative pressure. This negative pressure causes a powder inside a tank to be sucked into the nozzle through an abrasive hose, and then the powder is ejected from its nozzle tip.

As for the outline of the gravity blast machine, a nozzle for ejecting an abrasive, in a form of the one as shots mentioned above or of powder and the like, is disposed inside a cabinet having a gateway for taking in and out a material to be treated, and a pipe is connected to this nozzle. This pipe is connected to a compressor. A compressed gas is supplied from this compressor. A hopper is arranged under the cabinet. The lowest end of the hopper is connected through a conduit to an upper side face of a recollecting tank arranged above the cabinet, and the lower end of the recollecting tank is connected through a pipe to the nozzle. The abrasive in the recollecting tank is subjected to gravity or a given pressure so as to drop from the recollecting tank. The abrasive is then ejected together with the compressed gas supplied to the nozzle through the pipe to the cabinet.

In Example 1 which will be described later, titanium as an abrasive is introduced into the recollecting tank, the average particle size of shots of the titanium being 45 $\mu$m. This abrasive is in a substantially spherical form.

A material to be treated comprising 6A14V titanium alloy, is introduced from the gateway into a barrel inside the cabinet, and then the shots are ejected on the surface of the 6A14V titanium alloy at an ejection pressure of 0.6 MPa or more, an ejection speed of 80 m/sec or more, and an ejection distance of 100 mm.

The ejected abrasive, and dust produced at this time drop into the hopper below the cabinet, and then rise by a rising air current which is being generated in the conduit so that they are forwarded to the recollecting tank. Thus, the abrasive is recollected. The dust inside the recollecting tank is introduced from the upper end of the recollecting tank through the pipe to the dust collector by means of an air current inside the recollecting tank, and then is collected at the bottom of the dust collector. Normal gas is discharged from the exhauster arranged at the upper portion of the duct collector.

Moreover, a nitrogen cylinder not illustrated is used as a source for supplying a compressed gas, and nitrogen as the compressed gas is forwarded through the aforementioned pipe, so that the ejection powder of titanium is pressed and forwarded together with nitrogen as described above. Thus, the powder is supplied through the pipe to the ejection nozzle having a nozzle diameter of 5 mm and then is ejected onto the 6A14V titanium alloy inside the barrel of the cabinet.

The conditions for blasting work carried out in the aforementioned blast machine are shown in the following table.

TABLE 1

| Example 1 | |
|---|---|
| Blast machine | Gravity blast machine |
| Workpiece | 6A14V titanium alloy |
| Ejection powder | |
| Material | titanium |
| particle size | average particle size 45 $\mu$m |
| Ejecting gas | Nitrogen |
| Ejection pressure | 0.6 MPa |
| Ejection speed | 80 m/sec or more |
| Ejection nozzle diameter | 7 mm |
| Ejection distance | 100 mm |
| Ejection time | 2 minutes |

When titanium, which was an ejection powder, was ejected by nitrogen gas in the aforementioned processing, a TiN coat was formed on the surface of the 6A14V titanium alloy, so that its color became golden and hardness of its surface was raised. Moreover, its appearance became beautiful. Thus, its commercial value was improved.

EXAMPLE 2

TABLE 2

| | |
|---|---|
| Blast machine | Gravity blast machine |
| Workpiece | SUS 304 |
| Ejection powder | |
| Material | Titanium |
| Particle size | Average particle size 45 $\mu$m |
| Ejecting gas | Nitrogen |
| Ejection pressure | 0.6 MPa |
| Ejection speed | 80 m/sec or more |
| Ejection nozzle diameter | 7 mm |
| Ejection distance | 100 mm |
| Ejection time | 30 seconds |

When titanium, which was an ejection powder, was ejected by nitrogen gas in the aforementioned processing, a TiN coat was formed on the surface of the SUS 304, so that its color became golden and hardness of its surface was raised. Moreover, its appearance became beautiful. Thus, its commercial value was improved.

EXAMPLE 3

TABLE 3

| | |
|---|---|
| Blast machine | Gravity blast machine |
| Workpiece | ADC 12 die-cast product |
| Ejection powder | |
| Material | Aluminum |
| particle size | Average particle size 55 $\mu$m |
| Ejecting gas | Nitrogen |
| Ejection pressure | 0.4 MPa |
| Ejection speed | 80 m/sec or more |
| Ejection nozzle diameter | 5 mm |
| Ejection distance | 200 mm |
| Ejection time | 20 seconds |

When aluminum, which was an ejection powder, was ejected by nitrogen gas in the aforementioned processing, an AlN coat was formed on the surface of the ADC 12, so that its color became gray and hardness of its surface was raised. Moreover, the life of its sliding portion was greatly improved.

Additionally, nitrogen was used as the ejecting gas and, in consequence, a spark was not generated when the ejection powder collided with the material to be treated, and further dust explosion of aluminum was also able to be prevented. Thus, this processing was safe.

Next, the nitriding treatments at ordinary temperate of the present invention wherein air and nitrogen were used as a compressed gas were compared, and then were verified.

EXAMPLE 4

TABLE 4

| | |
|---|---|
| Blast machine | Gravity blast machine |
| Workpiece | Product corresponding to AC 1 A, 10 × 5 (t) × 50 mm (L) |
| Ejection powder | |
| Material | Alumina silica beads |
| Particle size | Average particle size 50 μm (#300) |
| Ejection pressure | 0.39 MPa |
| Ejection speed | 80 m/sec or more |
| Ejection nozzle diameter | 9 mm |
| Ejection distance | 100 mm |
| Ejection time | 10 seconds (for one side) |

| | Ejecting gas | |
|---|---|---|
| | Nitrogen | Air |
| Hardness of the material to be treated | Hv 350 | Hv170 |

According to SEM images (X-ray analysis), (label: 7NKα, full scale (cps 125), and label: 13 AlKα, full scale 5000) surface layer of about 15 μm thickness was nitrided. The aforementioned rise in the hardness was supported.

EXAMPLE 5

The following shows compression residual stress.

TABLE 5

| | |
|---|---|
| Blast machine | Gravity blast machine |
| Workpiece | A2000 forged piston ϕ 80 × 50 mm (L) |
| Ejection powder | |
| Material | Zirconia (ZrO2) |
| particle size | Average particle size 40 μm (#400) polygon |
| Ejection pressure | 0.49 MPa |
| Ejection speed | 80 m/sec or more |
| Ejection nozzle diameter | 9 mm |
| Ejection distance | 150 mm |
| Ejection time | 60 seconds |
| Compression stress of the surface of the workspace | MPa |

| Depth from the surface (μ) | Ejecting gas | |
|---|---|---|
| | Nitrogen | Air |
| 0 | 250 | 200 |
| 7 | 260 | |
| 8 | | 240 |
| 17 | 230 | 250 |

X-ray stress measuring method

According to Example 5, the material to be treated were nitrided at the depth of 7–8μ, dispersion of zirconia and fine nitriding were simultaneously carried out to improve heat resistance and wear resistance. Furthermore, the upper face of the material to be treated was plated with nickel, and the side faces thereof were plated with tin. As a result, heat resistance and slide wear resistance were greatly improved.

EXAMPLE 6

TABLE 6

| | |
|---|---|
| Blast machine | Gravity blast machine |
| Workpiece | SUS 304 belt: ϕ 300 × 15 × 0.2 mm (t) |
| Ejection powder | |
| Material | Tin |
| Particle size | Average particle size 50 μm (#300) substantially spherical form |
| Ejection pressure | 0.54 MPa |
| Ejection speed | 80 m/sec or more |
| Ejection nozzle diameter | 9 mm |
| Ejection distance | 150 mm |
| Ejection time | 120 seconds |
| Compression stress of the surface of the workspace | MPa |

| Depth from the surface (μ) | Ejecting gas | |
|---|---|---|
| | Nitrogen | Air |
| 0 | 1400 | 600 |

X-ray stress measuring method

In Example 6, a tin coat of about 2μ thickness was formed on the surface of the material to be treated, and increase in the compression residual stress demonstrated that fine nitriding was carried out by treatment with nitrogen gas. The aforementioned belts were used as a multi layered belt. As a result, remarkable wear resistance and expansion of its life were recognized, together with silencing effect.

What is claimed is:

1. A method for forming a nitrified layer on a ceramic coated product, which comprises ejecting a mixture of an ejection powder and a reactive ejecting gas on a surface of a material to be treated comprising a metal product, a ceramic or a mixture thereof by blasting using the mixture of the ejection powder and the reactive ejecting gas, thereby causing a compound produced by chemical reaction of the ejection powder and the reactive ejecting gas to diffuse and penetrate into the surface of the material to be treated, or forming the compound as a coat onto the surface of the material to be treated, wherein the reactive ejecting gas consists essentially of nitrogen gas and wherein either the ejection powder or the material to be treated comprises a nitrogen reactive component selected from the group consisting of Ti, V, Al, Cr and mixtures thereof.

2. The method for forming a ceramic coated product according to claim 1, wherein the shape of the ejection powder is in a substantially spherical or polygonal form.

3. The method for forming a ceramic coated product according to claim 1, wherein the size of the ejection powder is from 200 to 20 μm.

4. The method for forming a ceramic coated product according to claim 1, wherein the ejection of the ejection powder is carried out at an ejection speed of 80 m/sec or more, or at an ejection pressure of 0.3 MPa or more.

5. The method for forming a ceramic coated product according to claim 1, wherein at least the surface of the material to be treated and/or the reactive ejecting gas are heated.

6. The method for forming a ceramic coated product according to claim 3, wherein the size of the ejection powder is from 100 to 20 μm.

7. The method of claim 1, wherein the compound produced on the material to be treated by the chemical reaction of the ejection powder and the reactive ejecting gas is a nitride layer selected from the group consisting of TiN, VN, AlN and CrN.

8. The method of claim 1, wherein the nitrified layer is produced in both of the material to be treated and the coat.

9. The method of claim 1, wherein the nitrified layer is produced only in the coat.

10. The method of claim 1, wherein said material to be treated is aluminum.

* * * * *